US007187337B2

(12) United States Patent
Aikawa et al.

(10) Patent No.: US 7,187,337 B2
(45) Date of Patent: Mar. 6, 2007

(54) PLANAR ANTENNA WITH SLOT LINE

(75) Inventors: Masayoshi Aikawa, Saga (JP); Eisuke Nishiyama, Saga (JP); Fumio Asamura, Saitama (JP); Takeo Oita, Saitama (JP)

(73) Assignees: Nihon Dempa Kogyo Co., Ltd, Tokyo (JP); Saga University, Saga (JP)

( * ) Notice: Subject to any disclaimer, the term of this patent is extended or adjusted under 35 U.S.C. 154(b) by 0 days.

(21) Appl. No.: 11/046,547

(22) Filed: Jan. 28, 2005

(65) Prior Publication Data

US 2005/0200530 A1 Sep. 15, 2005

(30) Foreign Application Priority Data

Jan. 28, 2004 (JP) ..... 2004-020525

(51) Int. Cl.
*H01Q 13/10* (2006.01)

(52) U.S. Cl. ..... 343/767; 343/768; 343/700 MS

(58) Field of Classification Search ..... 343/700 MS, 343/767, 768, 769
See application file for complete search history.

(56) References Cited

U.S. PATENT DOCUMENTS

| | | | | |
|---|---|---|---|---|
| 4,509,209 | A * | 4/1985 | Itoh et al. | 455/327 |
| 6,753,824 | B2 * | 6/2004 | Thudor et al. | 343/769 |
| 6,756,857 | B2 | 6/2004 | Aikawa et al. | |
| 6,798,384 | B2 * | 9/2004 | Aikawa et al. | 343/700 MS |
| 6,825,816 | B2 | 11/2004 | Aikawa et al. | |
| 6,999,038 | B2 * | 2/2006 | Louzir et al. | 343/770 |

FOREIGN PATENT DOCUMENTS

| | | |
|---|---|---|
| JP | 2003-110322 | 4/2003 |
| JP | 2004-007034 | 1/2004 |

* cited by examiner

*Primary Examiner*—Hoang V. Nguyen
(74) *Attorney, Agent, or Firm*—Katten Muchin Rosenman LLP

(57) ABSTRACT

A slot-line planar antenna has a substrate, an outer conductor disposed on one principal surface of the substrate and having an opening defined therein, an inner conductor disposed on the one principal surface of the substrate and positioned within the opening, the outer conductor and the inner conductor jointly defining a looped aperture line therebetween, and an electronic device electrically interconnecting the outer conductor and the inner conductor for controlling an electromagnetic wave field of a slot line provided by the aperture line.

15 Claims, 5 Drawing Sheets

PLANAR ANTENNA WITH SLOT LINE

BACKGROUND OF THE INVENTION

1. Field of the Invention

The present invention relates to a planar antenna for use in frequency bands such as millimeter wave and microwave bands, and more particularly to a planar antenna which has a slot line and is capable of controlling an electromagnetic wave field to change an antenna frequency and a plane of polarization and which can be easily designed.

2. Description of the Related Art

Generally, planar antennas are widely used in radio communications and reception of satellite broadcasts as they can easily be processed and small in size and light in weight. The inventors of the present invention have proposed a planar antenna having an array of slot-line antenna elements disposed on a substrate, as disclosed in Japanese laid-open patent publication No. 2004-7034 (JP, P2004-7034A), and have also proposed a microstrip-line planar antenna for controlling an electromagnetic wave field to change an antenna frequency and a plane of polarization, as disclosed in Japanese laid-open patent publication No. 2003-110322 (JP, P2003-110322A).

FIGS. 1A and 1B show a conventional frequency-variable microstrip-line planar antenna. The illustrated microstrip-line planar antenna basically comprises a microstrip-line resonator. The antenna has substrate 1 made of a dielectric material which supports, on one principal surface thereof, resonant conductor 3 and feeding line 2 extending from resonant conductor 3 to an end of substrate 1. Substrate 1 also supports ground conductor 4 disposed on and extending fully over the other principal surface of substrate 1. Each of feeding line 2 and resonant conductor 3 has a microstrip-line structure.

Resonant conductor 3 has an opening 5, which is of a rectangular shape, for example, defined substantially centrally therein, exposing the one principal surface of substrate 1 therethrough. Electronic device 6 is disposed across opening 5 to interconnect opposite sides of resonant conductor 3 which are positioned across opening 5. Electronic device 6 comprises variable-reactance device 6A which may be, for example, a voltage-variable capacitance device whose capacitance is variable depending on a voltage applied thereto. In the illustrated microstrip-line planar antenna, the voltage-variable capacitance device comprises a pair of varactor diodes connected in series to each other with their respective cathodes connected to each other. The anodes of the varactor diodes are connected respectively to the opposite sides of resonant conductor 3 which are positioned across opening 5. Conductive line 7 is connected to the common junction between the cathodes of the varactor diodes. Reverse-biasing control voltage V1 is applied between conductive line 7 and resonant conductor 3.

In this arrangement, when control voltage V1 is changed, the capacitances of the varactor diodes are changed, changing boundary conditions for developing an electromagnetic wave field on resonant conductor 3. In this manner, the resonant frequency (i.e., antenna frequency) of the microstrip-line planar antenna is changed. Stated otherwise, the resonant frequency, i.e., the antenna frequency, can be controlled by changing control voltage V1 applied to the varactor diodes of variable-reactance device 6A.

The same principles are also applicable to a variable-polarization-plane microstrip-line planar antenna shown in FIG. 2. As shown in FIG. 2, the variable-polarization-plane microstrip-line planar antenna includes circular resonant conductor 3 having circular opening 5 defined concentrically therein and switching device 6B disposed across circular opening 5. Switching device 6B corresponds to electronic device 6 of the planar antenna shown in FIGS. 1A and 1B, and comprises four PIN diodes, for example. The four PIN diodes are in a star-connected configuration wherein the diodes in each diametrically opposite pair are connected in reverse polarity. Specifically, the four diodes are connected to common junction O, with the first and third diodes having respective anodes connected to common junction O and the second and fourth diodes having respective cathodes connected to common junction O. Circular resonant conductor 3 is divided into four sectors to define four quadrant points, i.e., left, lower, right, and upper quadrant points, around circular opening 5. The first diode has a cathode connected to the left quadrant point, the second diode has an anode connected to the lower quadrant point, the third diode has a cathode connected to the right quadrant point, and the fourth diode has an anode connected to the upper quadrant point. Feeder 2 extends from an upper right corner as shown of the substrate obliquely downwardly toward the center of resonant conductor 3, and is connected to an outer edge of resonant conductor 3. Conductive line 7 for applying switching control voltage V2 is connected to common junction O.

Resonant conductor 3 shown in FIG. 2 has resonant modes of $TM_{11}$ which are degenerated in both vertical and horizontal directions. These two resonant modes have the same resonant frequency. When negative control voltage V2 is applied to render the second and fourth diodes in the vertical pair conductive, the vertically resonant mode of the degenerated resonant modes is not excited. When positive control voltage V2 is applied to render the first and third diodes in the horizontal pair conductive, the horizontally resonant mode of the degenerated resonant modes is not excited. Therefore, resonant conductor 3 is resonated in either one of the degenerated resonant modes by selectively turning on the vertical and horizontal pairs of diodes of switching device 6B. In this manner, the planar antenna shown in FIG. 2 is capable of switching between planes of polarization for transmitted and received electromagnetic waves.

With the conventional microstrip-line planar antennas described above, the microstrip-line resonator, i.e., the resonant conductor, has the opening for placing the electronic device for controlling frequencies and planes of polarization. The basic design of the microstrip-line resonator itself is complex because electric characteristics, e.g., the resonant frequency, of the microstrip-line resonator are subject to change depending on the shape and size of the opening. In addition, inasmuch as control voltage V1, V2 is applied from a control circuit (not shown) to the electronic device disposed across the opening, a component such as a choke coil is required to isolate the resonant conductor and the control circuit from each other at high frequencies. Consequently, the conventional microstrip-line planar antennas are made up of a large number of parts, and their control circuits are complex in structure.

Generally, microstrip-line planar antennas have a narrow frequency range, a low antenna gain, and a high radiation level of the cross polarization component from the antenna element. The cross polarization component refers to a polarization component which is perpendicular to the polarization component that is originally intended for transmitting and receiving electromagnetic waves. Another problem is that the feeding line connected to the resonant conductor tends to affect the boundary conditions of the microstrip-line resonator in the vicinity of the junction between the feeding line and the resonant conductor.

SUMMARY OF THE INVENTION

It is an object of the present invention to provide a planar antenna which can easily be designed and is capable of changing antenna frequencies and planes of polarization.

The above object can be achieved by a slot-line planar antenna including a substrate, an outer conductor disposed on one principal surface of the substrate and having an opening defined therein, an inner conductor disposed on the one principal surface of the substrate and positioned within the opening, the outer conductor and the inner conductor jointly defining a looped aperture line therebetween, and an electronic device electrically interconnecting the outer conductor and the inner conductor for controlling an electromagnetic wave field of a slot line provided by the aperture line.

Microstrip-line planar antennas are required to have an opening formed in a resonant conductor for controlling an electromagnetic wave field. However, the slot-line planar antenna according to the present invention inherently has the aperture line that can be used as an opening to control an electromagnetic wave field in a slot-line resonator. The electronic device is loaded across the aperture line of the slot-line resonator to control the electromagnetic wave field in the slot-line resonator. With the slot-line resonator being thus used, no design change is required to provide an opening, and hence the planar antenna can be designed with ease.

In the slot-line resonator, since the electromagnetic wave field concentrates along the aperture line between the outer conductor and the inner conductor, no high-frequency current is basically present in the vicinity of the central region of the inner conductor. With a conductive line being connected to the central region of the inner conductor for applying a control voltage to the electronic device, a component such as a choke coil for blocking high frequency components is not required.

The slot-line planar antenna according to the present invention offers advantages over the microstrip-line planar antennas in that it has a wider frequency range, a higher antenna gain, and a lower radiation level of the cross polarization components from the antenna element than the microstrip-line planar antennas.

The slot-line planar antenna according to the present invention can be fed from a feeding line disposed on the other principal surface of the substrate and electromagnetically coupled to the aperture line. Preferably, the feeding line comprises a microstrip line having an end portion superposed on the aperture line so that the end portion extends across the aperture line. According to the feeding structure, the feeding line is less liable to affect the boundary conditions of the slot-line resonator.

According to the present invention, the electronic device may comprise a component for controlling the electromagnetic wave field of the slot line to change the electric length of the slot line, for example. The electronic device of such a nature is effective to change and control the antenna frequency (i.e., resonant frequency). Such an electronic device may be a variable-reactance device such as a voltage-variable capacitance device. If a voltage-variable capacitance device is used as the electronic device, then the electromagnetic wave field of the slot line can be controlled by a control voltage applied to the voltage-variable capacitance device.

Alternatively, the electronic device may comprise a switching device.

For switching between planes of polarization of electromagnetic waves that are transmitted and received, the slot line may have, for example, two degenerated resonant modes perpendicular to each other, and the electronic device may control the electromagnetic wave field of the slot line to switch between the resonant modes. In this case, the electronic device should preferably comprise a switching device.

DETAILED DESCRIPTION OF THE PREFERRED EMBODIMENTS

Figure 1A:
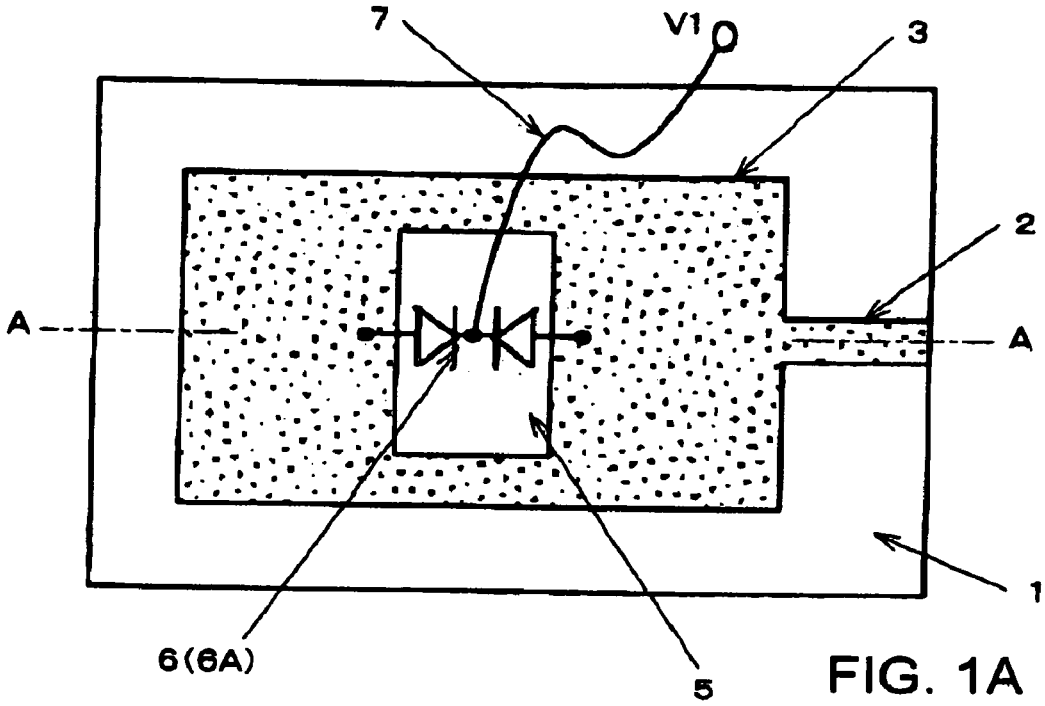
FIG. 1A (BACKGROUND ART)
FIG. 1A is a plan view illustrating a conventional frequency-variable microstrip-line planar antenna.
Figure 1B:
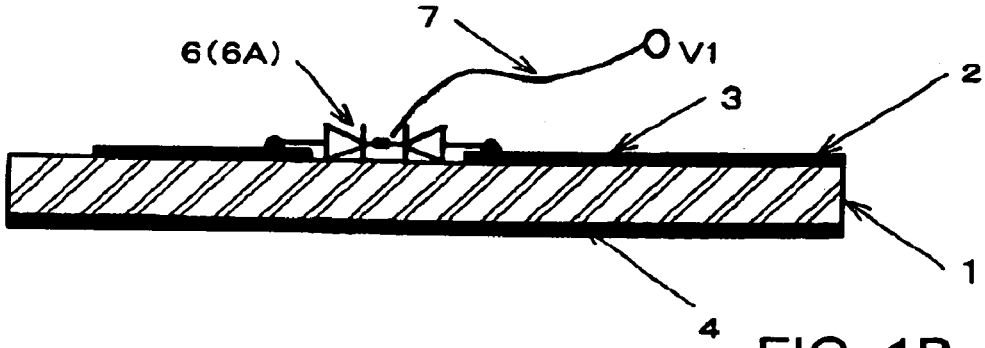
FIG. 1B (BACKGROUND ART)
FIG. 1B is a cross-sectional view taken along line A—A of FIG. 1A.
Figure 2:
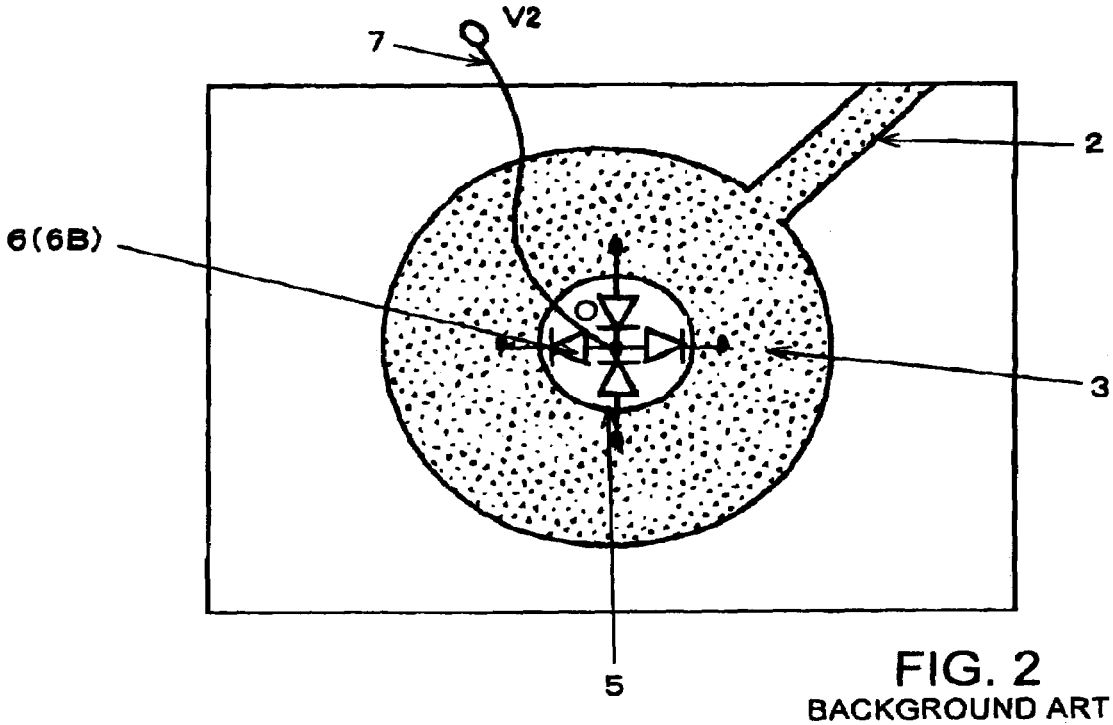
FIG. 2 BACKGROUND ART
FIG. 2 is a plan view illustrating a conventional variable-polarization-plane microstrip-line planar antenna.
Figure 3A:
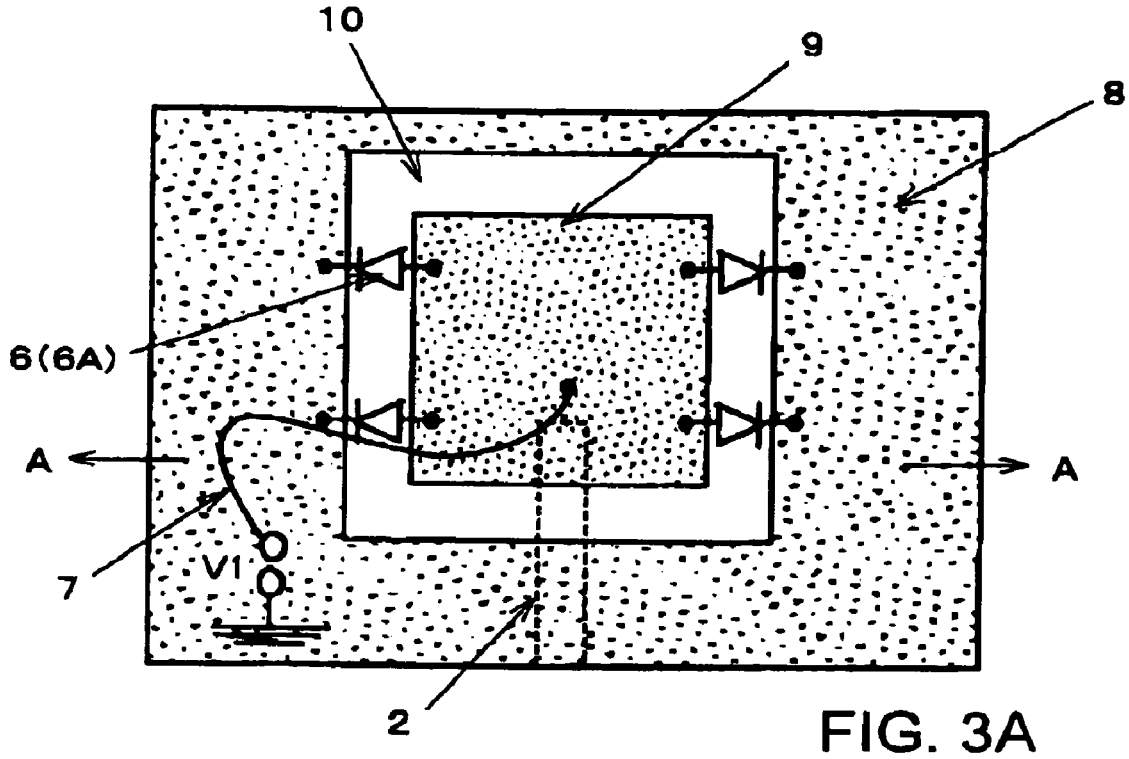
FIG. 3A is a plan view illustrating a frequency-variable slot-line planar antenna according to a first embodiment of the present invention.
Figure 3B:
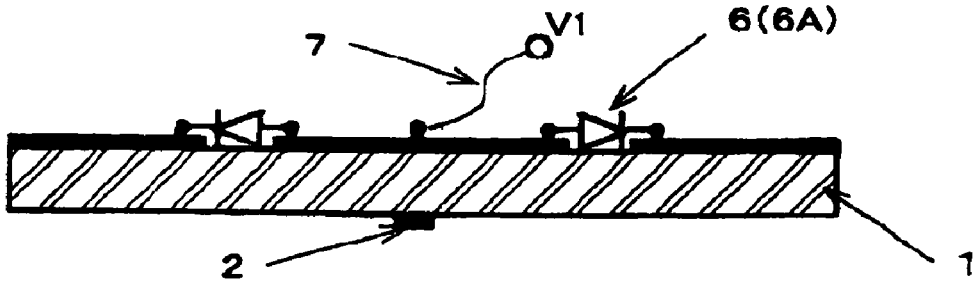
FIG. 3B is a cross-sectional view taken along line A—A of FIG. 3A.

A frequency-variable slot-line planar antenna according to a first embodiment of the present invention will be described below with reference to FIGS. 3A and 3B. As shown in FIGS. 3A and 3B, the planar antenna according to the first embodiment of the present invention has a slot-line resonator as an antenna radiator which has an electronic device for controlling the electromagnetic wave field of the slot-line resonator.

The planar antenna has substrate 1 made of a dielectric material and a metal conductor disposed on and extending fully over one principal surface of substrate 1. The metal conductor is partly removed linearly, providing aperture line 10 in the form of a rectangular loop. The portion of the remaining metal conductor which is positioned outside of aperture line 10 is referred to as outer conductor 8, and the portion of the remaining metal conductor which is positioned inside of aperture line 10 is referred to as inner conductor 9. The peripheral edge of outer conductor 8 which extends along aperture line 10 and inner conductor 9 are of rectangular shapes that are concentric to each other.

Electronic device 6 comprises variable-reactance devices 6A which may be, for example, voltage-variable capacitance devices such as varactor diodes. As shown in FIG. 3A, variable-reactance devices 6A are disposed on horizontally opposite sides of inner conductor 9 at upper and lower end portions thereof, and connected to inner conductor 9 and outer conductor 8. A total of four variable-reactance devices 6A are disposed across aperture line 10 symmetrically with respect to inner conductor 9 in vertical and horizontal directions. Variable-reactance devices 6A are disposed across aperture line 10 to connect the metal conductors of both side of aperture line 10 and have respective anodes connected to inner conductor 9 and respective cathodes connected to outer conductor 8. Conductive line 7 is connected to a central region of inner conductor 9 for applying control voltage V1 for changing the capacitance across variable-reactance devices 6A. Outer conductor 8 is grounded, and control voltage V1 is applied from a control circuit (not shown) through conductive line 7 to inner conductor 9 to reverse-bias variable-reactance devices 6A.

Feeding line 2 comprises a microstrip line disposed on the other principal surface of substrate 1. Feeding line 2 extends from an end of substrate 1 and has an end portion superposed on and extending across aperture line 10 to a position where feeding line 2 is superposed on inner conductor 9. Feeding line 2 is electromagnetically coupled to aperture line 10, i.e., a slot line, for feeding the slot line.

With this arrangement, the slot-line resonator has electromagnetic boundary conditions changed by the capacitance of the voltage-variable capacitance devices connected between outer conductor 8 and inner conductor 9. Therefore, the electric length of the slot line is substantially changed, changing the resonant frequency. The resonant frequency depends on the electric length of the slot line. Thus, the antenna frequency can be varied by control voltage V1.

In this slot-line planar antenna, the voltage-variable capacitance devices for controlling the electromagnetic wave field are disposed across aperture line 10 which is essentially required to form the slot line. The microstrip-line planar antennas need to additionally arrange an opening in the resonant system for changing frequency characteristics. However, the slot-line planar antenna according to the present embodiment is free of such an opening in addition to the resonant system and hence allows the slot-line resonator to be designed with ease.

In the slot-line resonator, since the electromagnetic wave field concentrates along aperture line 10 between outer conductor 8 and inner conductor 9, no high-frequency current and no high-frequency electric field are basically present in the vicinity of the central region of inner conductor 9. With conductive line 7 being connected to the central region of inner conductor 9 for applying control voltage V1 to voltage-variable capacitance devices, the control circuit is isolated from the slot-line resonator at high frequencies. Consequently, the control circuit can be designed independently of the slot-line resonator, and a component such as a choke coil is not required to isolate the control circuit from the slot-line resonator.

The slot-line planar antenna with the slot-line resonator has a wider frequency range, a higher antenna gain, and a less radiation level of cross polarization radiation generated from the antenna element than the microstrip-line planar antennas. Since feeding line 2 disposed on the other principal surface of substrate 1 feeds the slot-line resonator, feeding line 2 is less liable to affect the boundary conditions of the slot-line resonator.

In the above illustrated embodiment, two variable-reactance devices, e.g., varactor diodes, are connected to the right side of the slot-line resonator and two variable-reactance devices, e.g., varactor diodes, are connected to the left side of the slot-line resonator. However, variable-reactance devices are not limited to being disposed in those locations, but may be provided in different locations. For example, a total of two variable-reactance devices, e.g., varactor diodes, may be disposed one on each of horizontally opposite sides of the slot-line resonator. Alternatively, variable-reactance devices or varactor diodes may be disposed on vertically opposite sides of the slot-line resonator. Though variable-reactance devices may be disposed centrally on the sides of the slot-line resonator, variable-reactance devices thus positioned are less effective than otherwise positioned.

Figure 4:
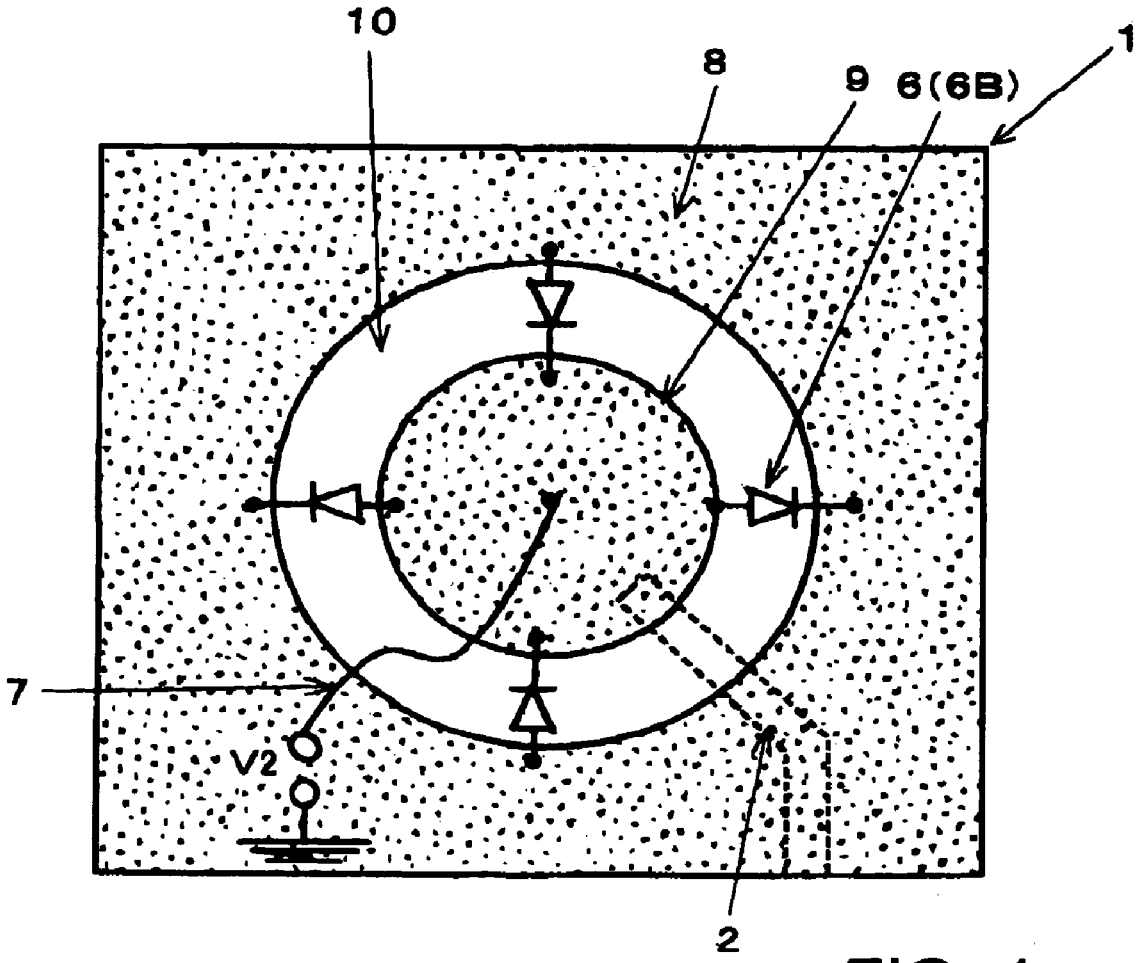
FIG. 4 is a plan view illustrating a variable-polarization-plane slot-line planar antenna according to a second embodiment of the present invention.

A variable-polarization-plane slot-line planar antenna according to a second embodiment of the present invention will be described below with reference to FIG. 4. Although the slot-line planar antenna shown in FIG. 4 is similar to the antenna according to the first embodiment, the planar antenna shown in FIG. 4 has circular aperture line 10 between inner conductor 9 and outer conductor 8. Therefore, inner conductor 9 is of a circular shape, and the peripheral edge of outer conductor 8 which extends along aperture line 10 is of a circular shape that is concentric to inner conductor 9.

The slot-line planar antenna shown in FIG. 4 has two perpendicular resonant modes which are degenerated in vertical and horizontal directions as shown. The two resonant modes have the same resonant frequency.

Electronic device 6 comprises four PIN diodes 6B disposed as switching devices across aperture line 10 of the slot-line resonator. Four PIN diodes 6B are in a star-connected configuration wherein the diodes in each diametrically opposite pair are connected in reverse polarity. Specifically, the first diode, i.e., the diode in the left position as shown, is disposed across circular aperture line 10, and has a cathode connected to outer conductor 8 and an anode connected to inner conductor 9, the second diode, i.e., the diode in the lower position as shown, is disposed across circular aperture line 10, and has an anode connected to outer conductor 8 and a cathode connected to inner conductor 9, the third diode, i.e., the diode in the right position as shown, is disposed across circular aperture line 10, and has a cathode connected to outer conductor 8 and an anode connected to inner conductor 9, and the fourth diode, i.e., the upper position as shown, is disposed across circular aperture line 10, and has an anode connected to outer conductor 8 and a cathode connected to inner conductor 9. Feeding line 2 is disposed on the other principal surface of substrate 1 and extends from a lower right corner as shown of substrate 1 obliquely upwardly toward the center of inner conductor 9.

Conductive line 7 for applying control voltage V2 to the diodes is connected to a central region of inner conductor 9. Outer conductor 8 is kept at a reference (ground) potential, and positive or negative control voltage V2 is applied from a control circuit (not shown) through conductive line 7 to inner conductor 9.

With this arrangement, when positive control voltage V2 is applied to inner conductor 9, the first and third diodes in the horizontal pair as shown are turned on, and the second and fourth diodes in the vertical pair as shown are turned off. Since outer conductor 8 and inner conductor 9 are short-circuited by the first and third diodes thus turned on, the horizontal resonant mode is not excited. Specifically, of the two degenerated perpendicular resonant modes, the vertical resonant mode is excited and the horizontal resonant mode is not excited. Therefore, the slot-line planar antenna shown in FIG. 4 can transmit and receive electromagnetic waves with the vertical plane of polarization. Conversely, when negative control voltage V2 is applied to inner conductor 9, the second and fourth diodes in the vertical pair as shown are turned on, exciting the horizontal resonant mode to enable the slot-line planar antenna to transmit and receive electromagnetic waves with the horizontal plane of polarization.

As with the planar antenna according to the first embodiment, the planar antenna according to the second embodiment allows the slot-line resonator to be designed with ease because the switching devices are disposed across the aperture line which is essentially required to form the slot line. Since the electromagnetic wave field concentrates along aperture line 10 between outer conductor 8 and inner conductor 9, no high-frequency current and no high-frequency electric field are basically present in the vicinity of the central region of inner conductor 9. Therefore, the control circuit for applying control voltage V2 is isolated from the slot-line resonator at high frequencies. Consequently, the control circuit can be designed independently of the slot-line resonator, and a component such as a choke coil is not required.

The slot-line planar antenna has a wide frequency range, a high antenna gain, and a low level of noise. Feeding line 2 is less liable to affect the boundary conditions of the slot-line resonator. Even if only the first and second diodes are provided and the second and fourth diodes are dispensed with in the structure shown in FIG. 4, such a modified arrangement is effective to control the planes of polarization. Likewise, even if only the third and fourth diodes are provided and the first and third diodes are dispensed with in the structure shown in FIG. 4, such a modified arrangement is also effective to control the planes of polarization.

Figure 5:
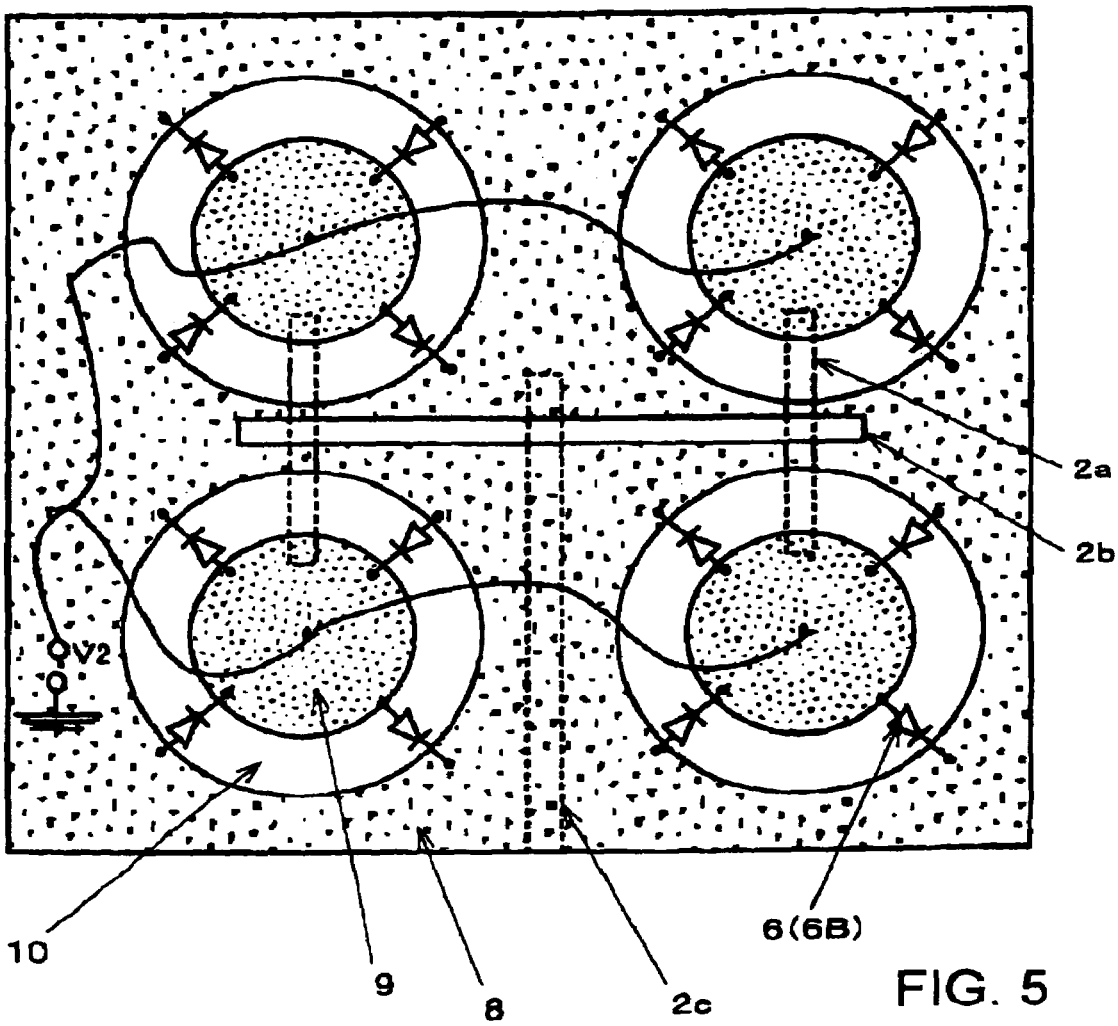
FIG. 5 is a plan view illustrating a slot-line planar array antenna.

A plurality of slot-line planar antennas described above may be disposed in a matrix configuration, for example, on one substrate, providing an array antenna. FIG. 5 shows a planar array antenna having four of the variable-polarization-plane slot-line planar antenna shown in FIG. 4. A technology for constructing an array antenna of general slot-line planar antennas has been proposed in Japanese laid-open patent publication No. 2004-7034 (JP, P2004-7034A) by the inventors of the present invention. The planar array antenna shown in FIG. 5 has four slot-line planar antennas arranged in two horizontal rows and two vertical columns. The two slot-line planar antennas in each column are connected to each other by first feeding line 2*a* of a microstrip-line type disposed on the other principal surface of the substrate. Second feeding 2*b*, which is disposed as a linear slot line on one principal surface of the substrate, extends perpendicularly to the pair of first feeding lines 2*a* and is electromagnetically coupled to first feeder lines 2*a*. Third feeding line 2*c*, which extends perpendicularly to second feeding line 2*b* at the midpoint of second feeding line 2*b*, is disposed as a microstrip line on the other principal surface of the substrate. High-frequency power is supplied from a feed end of third feeding line 2*c* to the slot-line resonators of the four slot-line planar antenna elements.

While the 4-element array antenna is illustrated in FIG. 5, the same array antenna principles are applicable to produce an 8-element or 16-element array antenna. A plurality of frequency-variable slot-line planar antennas according to the first embodiment may also be combined into an array antenna.

What is claimed is:

1. A slot-line planar antenna comprising:

a substrate;

an outer conductor disposed on one principal surface of said substrate and having an opening defined therein;

an inner conductor disposed on said one principal surface of said substrate and positioned within said opening, said outer conductor and said inner conductor jointly defining a looped aperture line therebetween;

an electronic device electrically interconnecting said outer conductor and said inner conductor for controlling an electromagnetic wave field of a slot line provided by said aperture line, said electronic device constituting a portion of electromagnetic boundary conditions of said aperture line; and means for applying a control voltage between said outer conductor and said inner conductor thereby applying said control voltage to said electronic device, said electromagnetic wave field being controlled by said control voltage.

2. The planar antenna according to claim 1, further comprising a feeding line disposed on the other principal surface of said substrate and electromagnetically coupled to said aperture line, said aperture line being fed by said feeding line.

3. The planar antenna according to claim 2, wherein said feeding line comprises a microstrip line having an end portion superposed on said aperture line so that the end portion extends across said aperture time.

4. The planar antenna according to claim 1, wherein said slot line has two degenerated resonant modes perpendicular to each other, and said electronic device controls the electromagnetic wave field of said slot line to switch between said resonant modes.

5. The planar antenna according to claim 4, wherein said slot line is of a circular shape.

6. The planar antenna according to claim 5, wherein said electronic device comprises four electronic devices disposed respectively across four quadrant points of said slot line.

7. The planar antenna according to claim 5, wherein said electronic device comprises a switching device.

8. The planar antenna according to claim 1, wherein said electronic device comprises a switching device.

9. A slot-line planar antenna comprising:

a substrate;

an outer conductor disposed on one principal surface of said substrate and having an opening defined therein;

an inner conductor disposed on said one principal surface of said substrate and positioned within said opening, said outer conductor and said inner conductor jointly defining a looped aperture line therebetween; and an electronic device electrically interconnecting said outer conductor and said inner conductor for controlling an electromagnetic wave field of a slot line provided by said aperture line, wherein said electronic device controls the electromagnetic wave field of said slot line to change an electric length of said slot line.

10. The planar antenna according to claim 9, wherein said electronic device comprises a variable-reactance device.

11. The planar antenna according to claim 10, wherein said variable-reactance device comprises a voltage-variable capacitance device.

12. The planar antenna according to claim 10, further comprising a conductive line connected to a central region of said inner conductor for applying a control voltage to said variable-reactance device.

13. The planar antenna according to claim 10, wherein said slot line is of a rectangular shape.

14. A slot-line planar antenna comprising:

a substrate;

an outer conductor disposed on one principal surface of said substrate and having an opening defined therein;

an inner conductor disposed on said one principal surface of said substrate and positioned within said opening, said outer conductor and said inner conductor jointly defining a looped aperture line therebetween; and an electronic device electrically interconnecting said outer conductor and said inner conductor for controlling an electromagnetic wave field of a slot line provided by said aperture line, wherein said electronic device comprises a variable-reactance device.

15. The antenna according to claim 14, wherein said variable-reactance device comprises a voltage-variable capacitance device.

* * * * *